US009950905B2

(12) United States Patent
Parkinson et al.

(10) Patent No.: US 9,950,905 B2
(45) Date of Patent: Apr. 24, 2018

(54) LINK-LESS CARGO HOOK ASSEMBLY

(71) Applicant: Capewell Aerial Systems LLC, South Windsor, CT (US)

(72) Inventors: Stephen T. Parkinson, Suffield, CT (US); Adam J. Fitzgerald, Enfield, CT (US)

(73) Assignee: Capewell Aerial Systems LLC, South Windsor, CT (US)

( * ) Notice: Subject to any disclaimer, the term of this patent is extended or adjusted under 35 U.S.C. 154(b) by 0 days.

(21) Appl. No.: 15/389,490

(22) Filed: Dec. 23, 2016

(65) Prior Publication Data

US 2017/0190549 A1 Jul. 6, 2017

Related U.S. Application Data

(60) Provisional application No. 62/272,913, filed on Dec. 30, 2015.

(51) Int. Cl.
*B66C 1/34* (2006.01)

(52) U.S. Cl.
CPC ..... *B66C 1/34* (2013.01)

(58) Field of Classification Search
CPC ..... B66C 1/34; B66C 1/38; B64D 17/383
USPC ..... 294/82.24, 82.26, 82.3, 82.33
See application file for complete search history.

(56) References Cited

U.S. PATENT DOCUMENTS 2,121,413 A * 6/1938 Strong ..... B64D 17/383 244/147
3,766,611 A * 10/1973 Gaylord ..... B64D 17/32 24/603
4,026,594 A * 5/1977 Kumpulainen ..... B66C 1/66 294/110.1
4,609,219 A * 9/1986 Go ..... B66C 1/66 294/82.24
5,273,333 A * 12/1993 Hatfield ..... B66C 1/34 294/82.26

* cited by examiner

*Primary Examiner* — Dean J Kramer
(74) *Attorney, Agent, or Firm* — Alix, Yale & Ristas, LLP

(57) ABSTRACT

A cargo hook assembly employing a connector strap and a frame attached to a lower kicker, a clamp, an upper kicker, and a shaft assembly. A transverse flange of the connector strap engages a ledge of the lower kicker and propels the lower kicker towards the frame. A clip of the lower kicker rotates the clamp towards a closed position. A tongue of the clamp engages the shaft assembly at a tongue groove. A remote electrical module, a remote mechanical module, and a local mechanical release rotate the shaft assembly to engage or disengage the shaft assembly from the upper kicker and tongue.

20 Claims, 12 Drawing Sheets

LINK-LESS CARGO HOOK ASSEMBLY

BACKGROUND

This disclosure relates generally to devices which join a payload to a helicopter, and allow the payload to be easily disconnected. More particularly, this disclosure relates to a cargo hook assembly.

In cargo hook technology, to which the present disclosure relates, devices which are employed for payload releases are typically complex structures that require multiple user inputs to secure and detach the payload. Current designs all employ a load beam with or without a keeper. In terms of payload to weight ratios, cargo hooks are inefficient in comparison to other aircraft release devices, for example personnel parachute releases.

An opportunity exists to significantly reduce the weight of cargo hooks, while maintaining a large payload, using a link-less parachute release concept. The link-less cargo hook requires similar functionality while allowing for automatic engagement. Operative reliability while minimizing complexity of the assembly is a constraint that cannot be compromised in any cargo hook assembly.

SUMMARY

Briefly stated, a cargo hook assembly comprises connector strap and a frame attached to a lower kicker, a clamp, an upper kicker, and a shaft assembly.

The connector strap has a transverse flange and a tip. The lower kicker has a ledge complementary to the transverse flange, a clip extending from the ledge, and a gap that accommodates the tip. The frame extends from a first end to a second end. The clamp pivots about a lower post of the frame adjacent the first end. The clamp contains a latch bar parallel to the lower post and a tongue extending from the end opposite the engagement with the lower post. The upper kicker is pivotally attached to the frame adjacent the second end. The shaft assembly is disposed adjacent the second end and comprises a rotatable shaft with a clamp groove complementary to the tongue and a kicker groove complementary to the upper kicker. The shaft assembly is operatively connected to a remote electrical module, a remote mechanical module, and a local mechanical release.

The transverse flange engages the ledge and propels the lower kicker towards the second end of the frame and the clip rotates the clamp towards the second end. The second kicker rotatably engages the shaft assembly at the kicker groove and the tongue engages the shaft assembly at the tongue groove. The remote electrical module, the remote mechanical module, and the local mechanical release independently rotate the rotatable shaft to engage or disengage the shaft assembly from the upper kicker and tongue.

DETAILED DESCRIPTION OF THE PREFERRED EMBODIMENT

Figure 1:
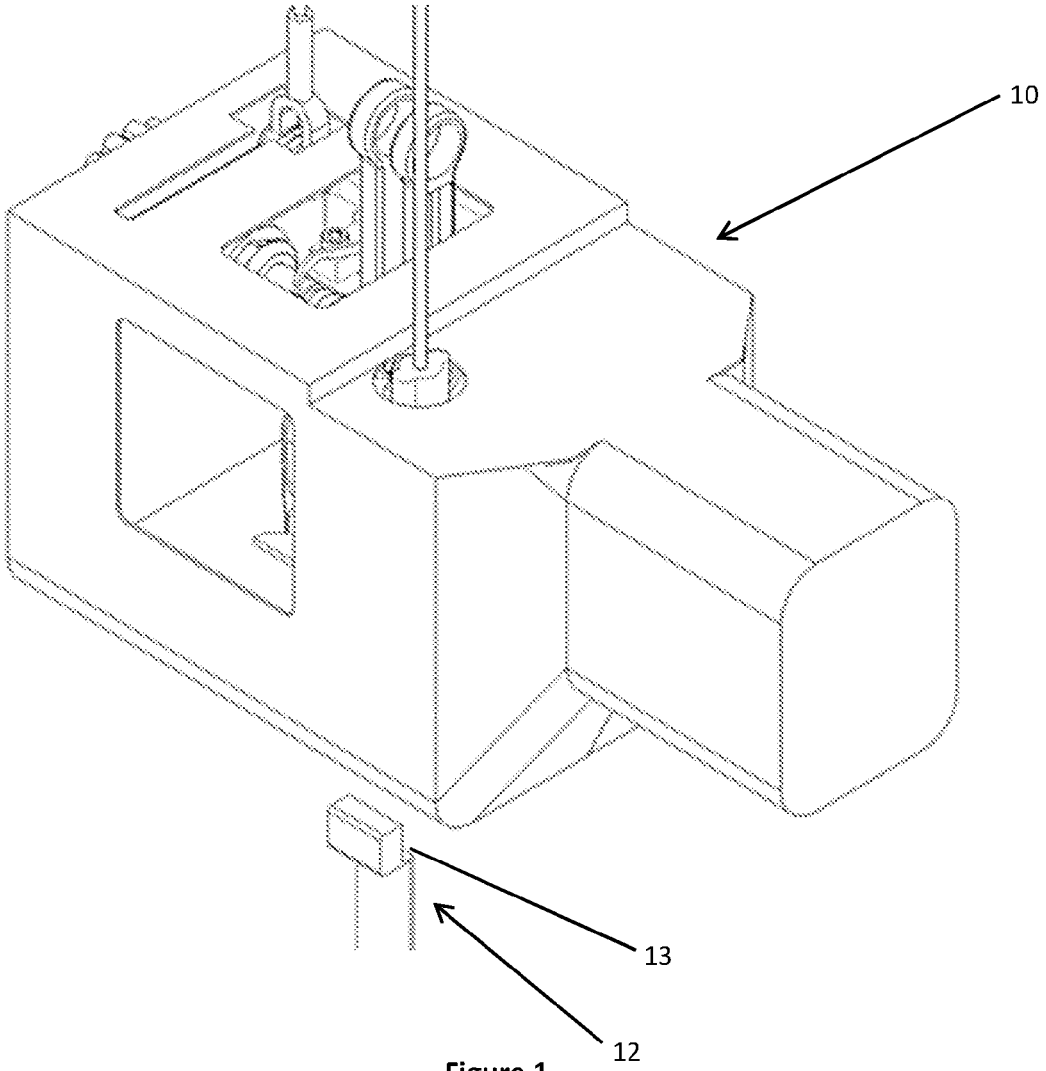
FIG. 1 is a frontal perspective view of a link-less cargo hook assembly.

With reference to the drawings wherein like numerals represent like parts throughout the figures, a link-less cargo hook assembly is generally designated by the numeral 10. With reference to FIG. 1, the link-less cargo hook assembly 10 functions to join a connector strap 12 for cargo to a helicopter (not depicted) and to allow the cargo to be easily disconnected from the helicopter when desired. The cargo strap 12 is connected at a lower end to a cargo load (not depicted) and terminates at the opposite end in tip 13.

Figure 2:
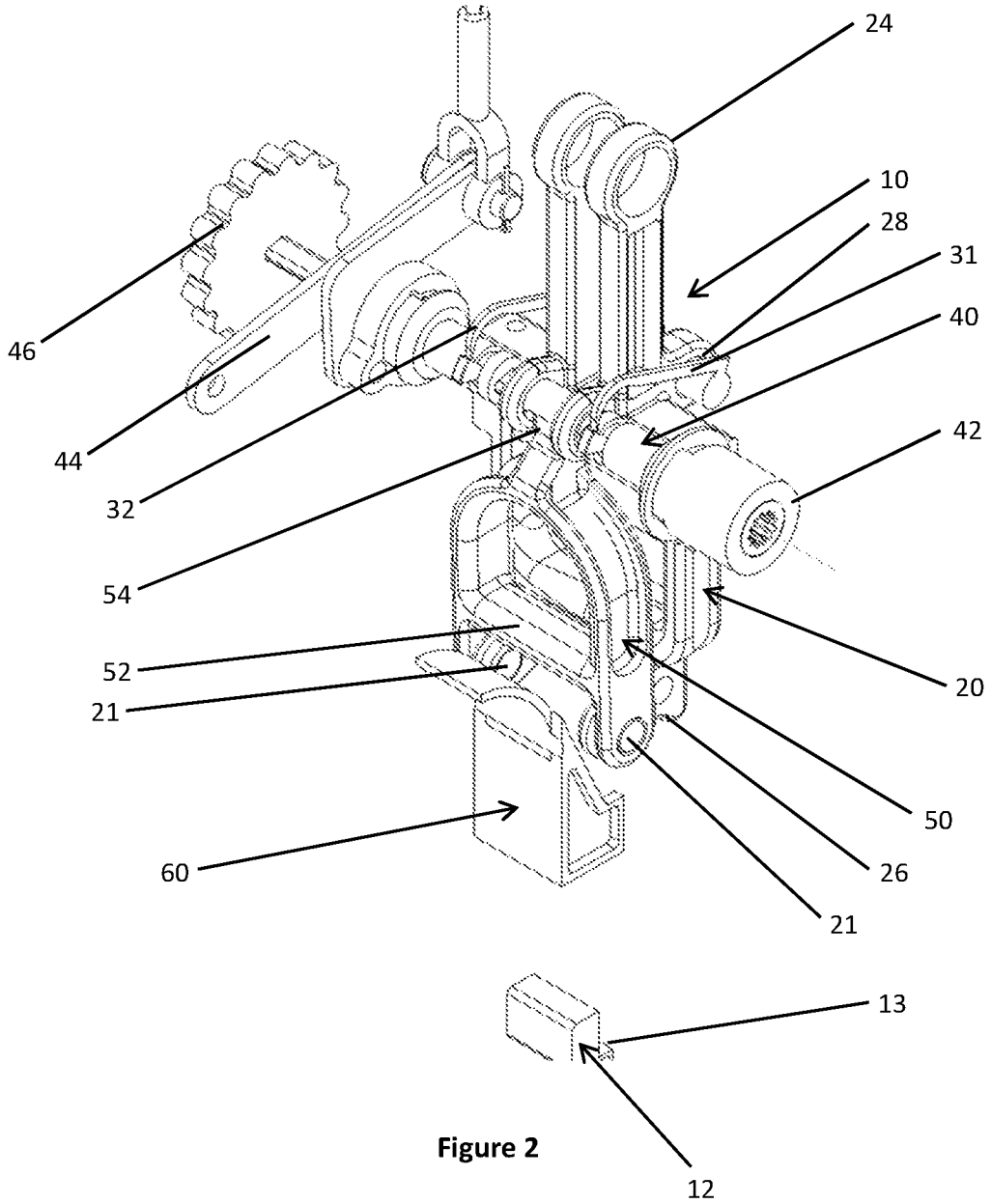
FIG. 2 is a frontal perspective view of the cargo hook assembly of FIG. 1 with the casing removed.
Figure 3:
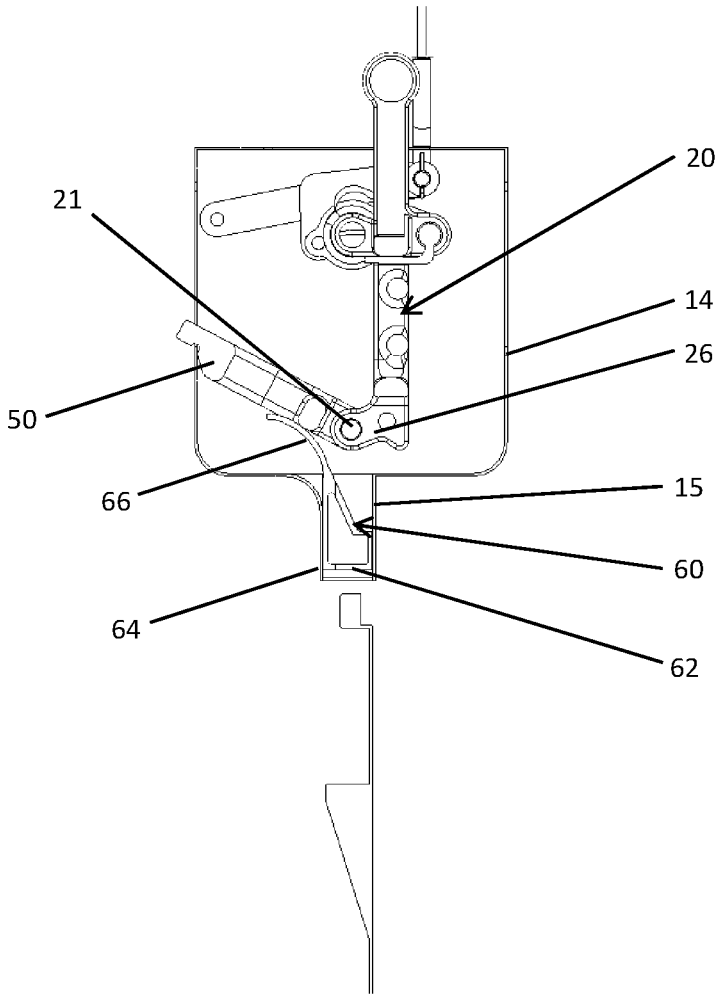
FIG. 3 is a side section view of the cargo hook assembly of FIG. 1.

With reference to FIGS. 2-3, the link-less cargo hook assembly 10 comprises a frame 20 which extends from an upper end 24 to a lower end 26. Between the upper end 24 and lower end 26 a pivot rod 28 is received to one side of the frame 20, for pivotally mounting an upper kicker 30 and a shaft assembly 40. The lower end 26 receives two lower posts 21 to affix a clamp 50 to the frame 20.

The upper kicker 30 preferably comprises a pair of pivotal clamp arms 31, 32 having a J-shaped configuration. Other shapes of the pivotal clamp arms 31, 32 do not significantly depart from the scope of the present disclosure. In the depicted embodiment, the arms 31, 32 are transversely spaced at opposite ends of the pivot rod 28. The arms 31, 32 rotate about pivot rod 28 and engage shaft assembly 40 on the opposite side of frame 20. The depicted shaft assembly 40 comprises a remote electrical module 42, a remote mechanical module 44, and a local mechanical release 46. The shaft assembly 40 is depicted in greater detail in FIGS. 5A and 5B.

The clamp 50 includes a latch bar 52 and a tongue 54. The clamp 50 pivots about two spaced lower posts 21 at the lower end 26 of frame 20. The tongue 54 engages a complementary support structure in shaft assembly 40. The latch bar 52 engages tip 13 of connector strap 12 to fully secure the connector strap 12 to the link-less cargo hook assembly 10.

Lower kicker 60 is retained in casing sleeve 15 of casing 14 and is movable towards the lower end 26 of frame 20. The depicted lower kicker 60 contains a ledge 64 surrounding a central gap 62 at a lower end and extends to a clip 66 at the opposite end. The clip 66 extends from the ledge 64 towards the clamp 50. The shape of the clip 66 may vary, but it is designed to close clamp 50 as the lower kicker 60 is pushed towards clamp 50. The lower kicker 60 may be retained in the casing sleeve 15 when the link-less cargo hook assembly 10 is not in use by contact with either the ledge 64 or the clip 66 with complementary structures in the casing sleeve 15 or casing 14.

Figure 4A:
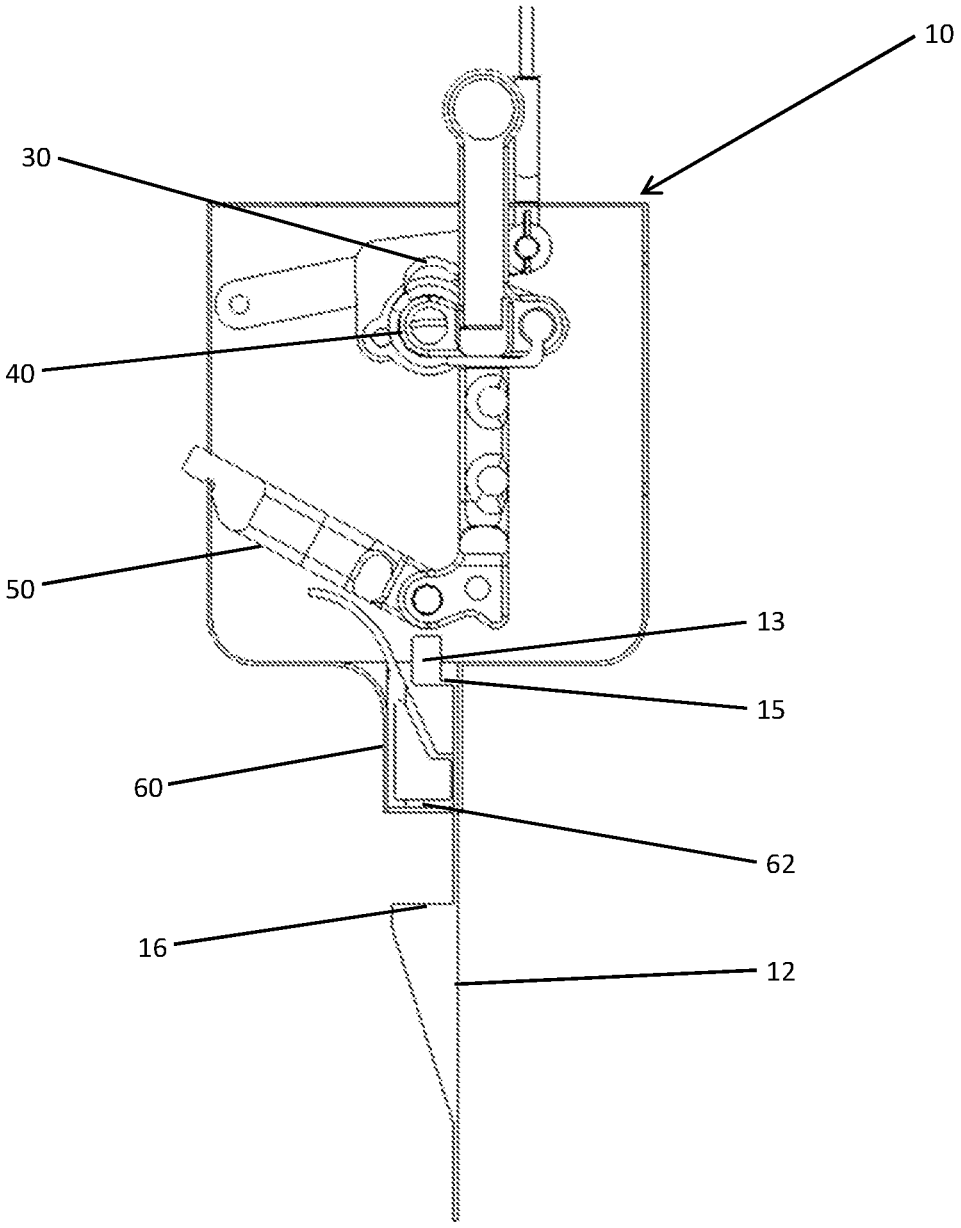
FIGS. 4A-4E are side sectional view of the cargo hook assembly of FIG. 1 beginning in a fully open state in FIG. 4A and progressing to a fully secured state in FIG. 4E.
Figure 4B:
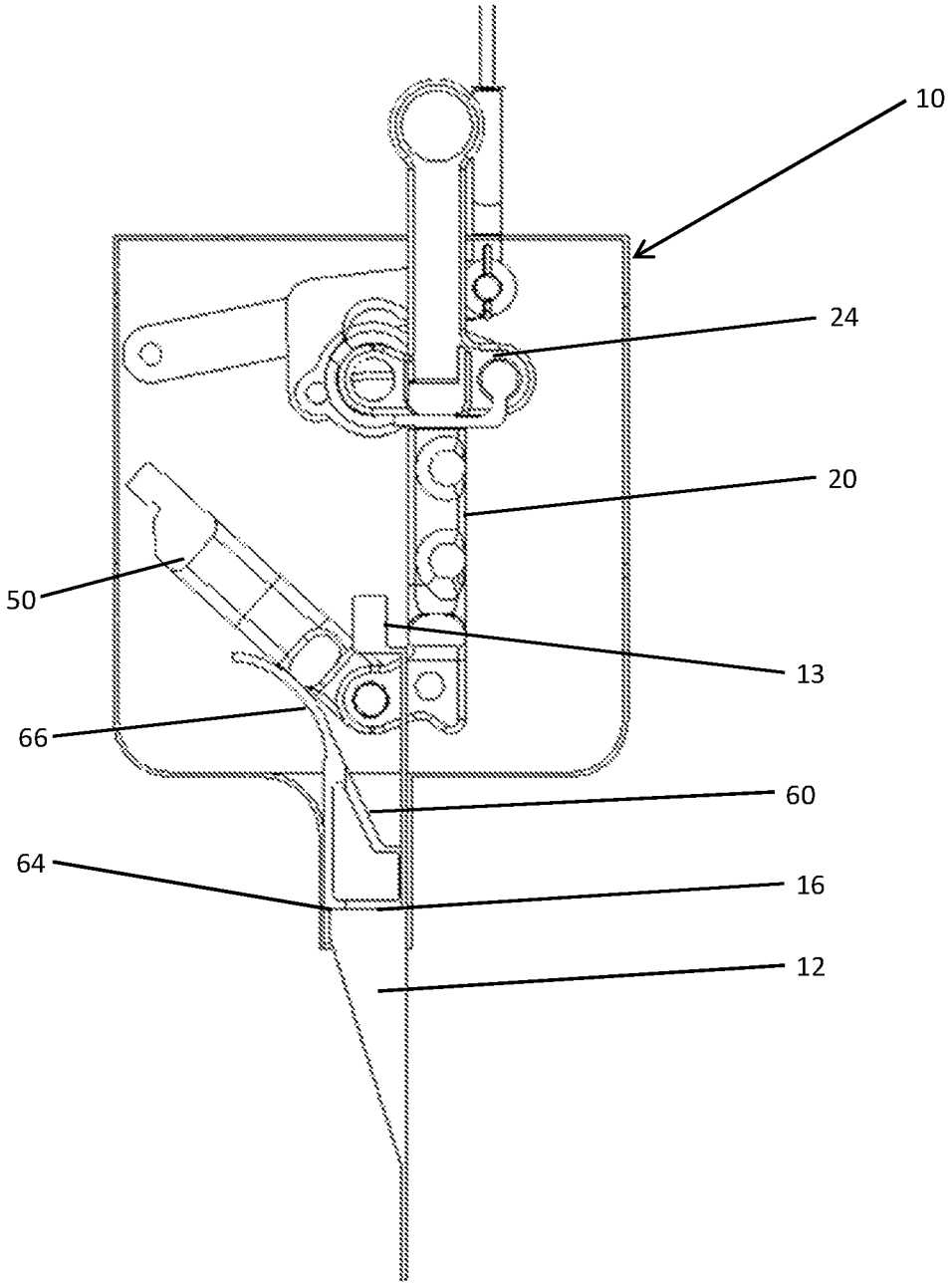
Figure 4C:
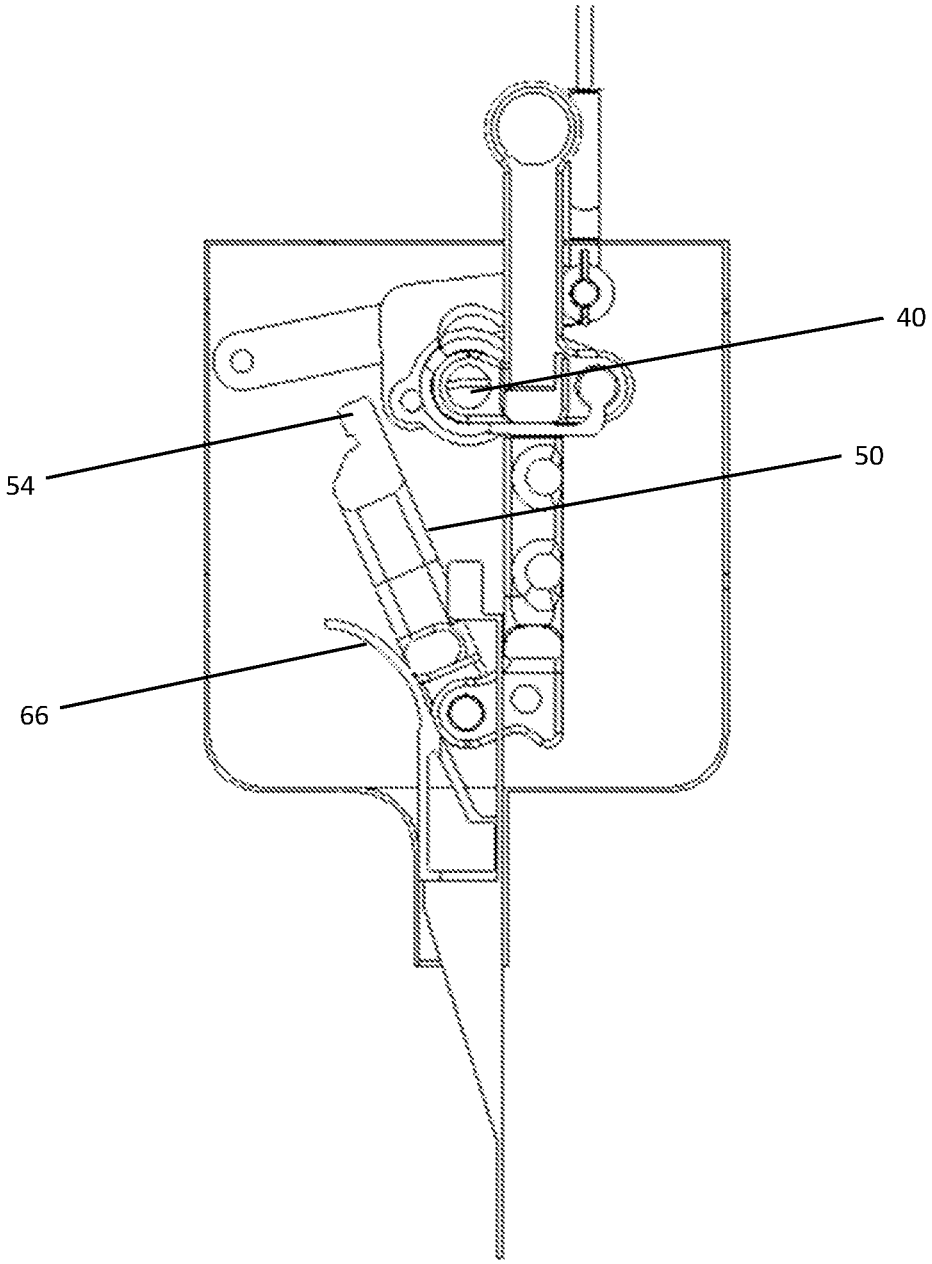
Figure 4D:
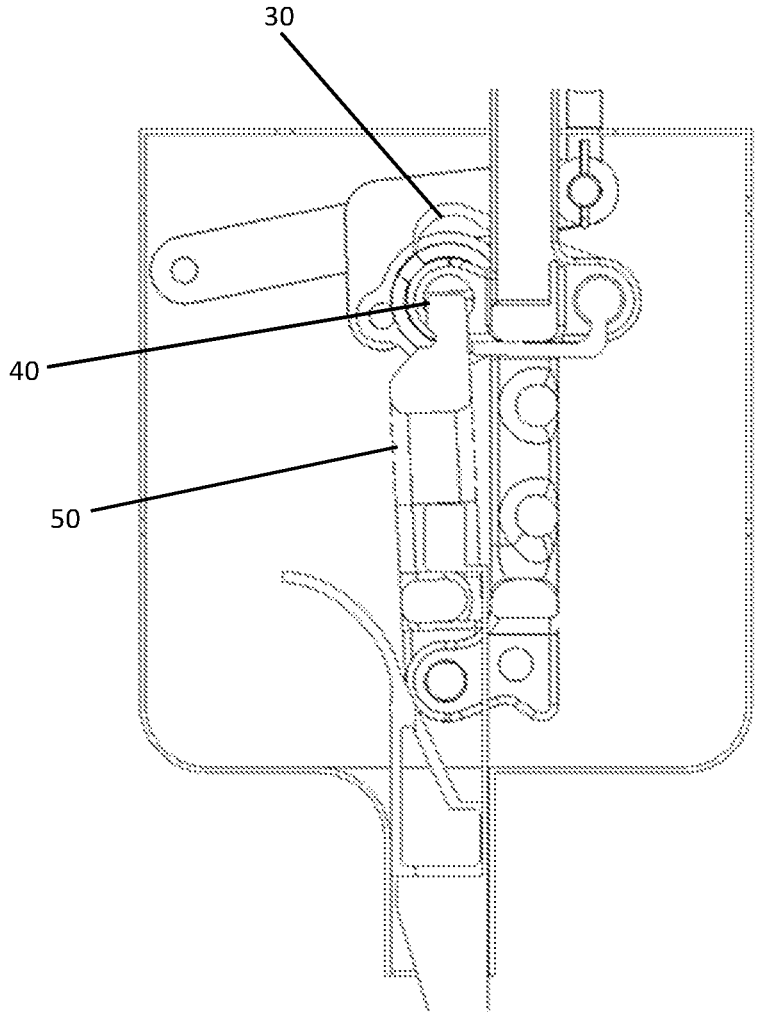
Figure 4E:
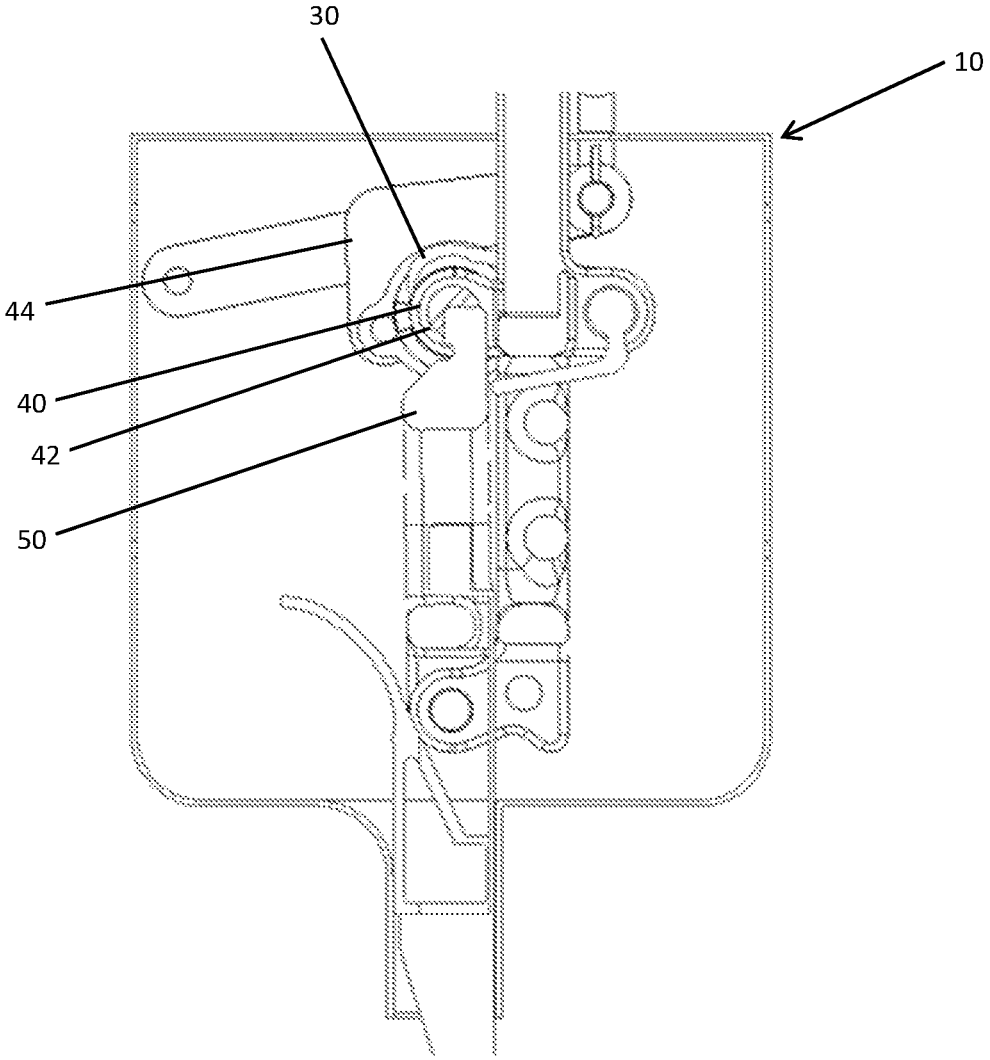

As best illustrated in FIGS. 4A-4E, the link-less cargo hook assembly 10 is transformable from a fully open mode of FIG. 4A to a fully secured mode of FIG. 4E. FIG. 4A depicts the link-less cargo hook 10 in a fully open position. The clamp 50 is in an open position and is not engaged with the tip 13 of connector strap 12. The upper kicker 30 is also in an open position and is not engaged with shaft assembly 40. The lower kicker 60 is held in place by casing sleeve 15. When the connector strap is inserted into casing sleeve 15, the tip 13 of connector strap 12 passes through gap 62 of the lower kicker 60. The lower kicker remains in its original position in casing sleeve 15 and the clamp 50 remains fully open.

Referring to FIG. 4B, as the tip 13 continues toward the upper end of the link-less cargo hook assembly 10, the flange 16 on the connector strap 12 engages a complementary ledge 64 on the lower kicker 60. The connector strap 12 pushes the lower kicker 60 towards the clamp 50 and a clip 66 extending from the ledge 64 of lower kicker 60 contacts the clamp 50. In the depicted embodiment, the clip 66 contacts the latch bar 52 of clamp 50.

Referring to FIG. 4C, the clip 66 moves clamp 50 from a fully open position towards a closed position (moving the tongue 54 towards the shaft assembly 40). FIG. 4D depicts the clamp 50 in a fully closed position. In the depicted position the upper kicker 30 remains disengaged from the shaft assembly 40.

FIG. 4E depicts the link-less cargo hook assembly 10 approaching the fully secured mode. The clamp 50 engages the upper kicker 30 to rotate the shaft assembly 40 to the fully closed position independently of the remote electrical module 42, remote mechanical module 44, and local mechanical release 46.

Figure 5A:
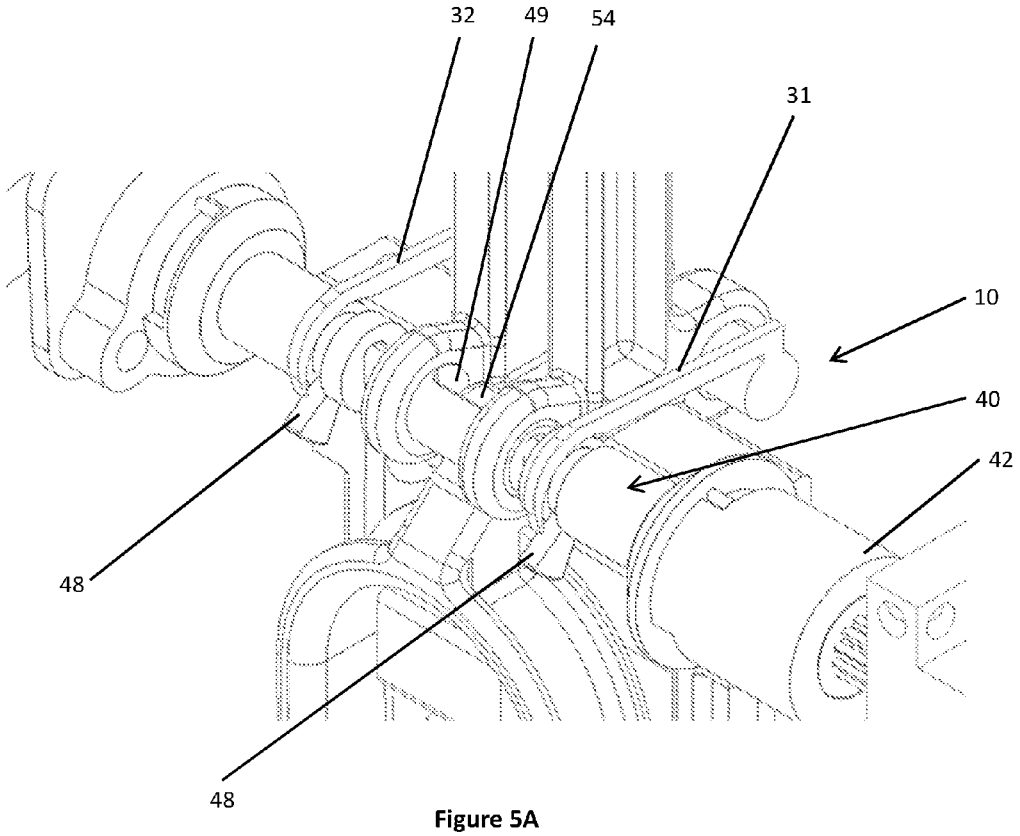
FIG. 5A is a partial frontal perspective views of the cargo hook assembly of FIG. 2 in a fully open state depicting the remote electrical module in greater detail.
Figure 5B:
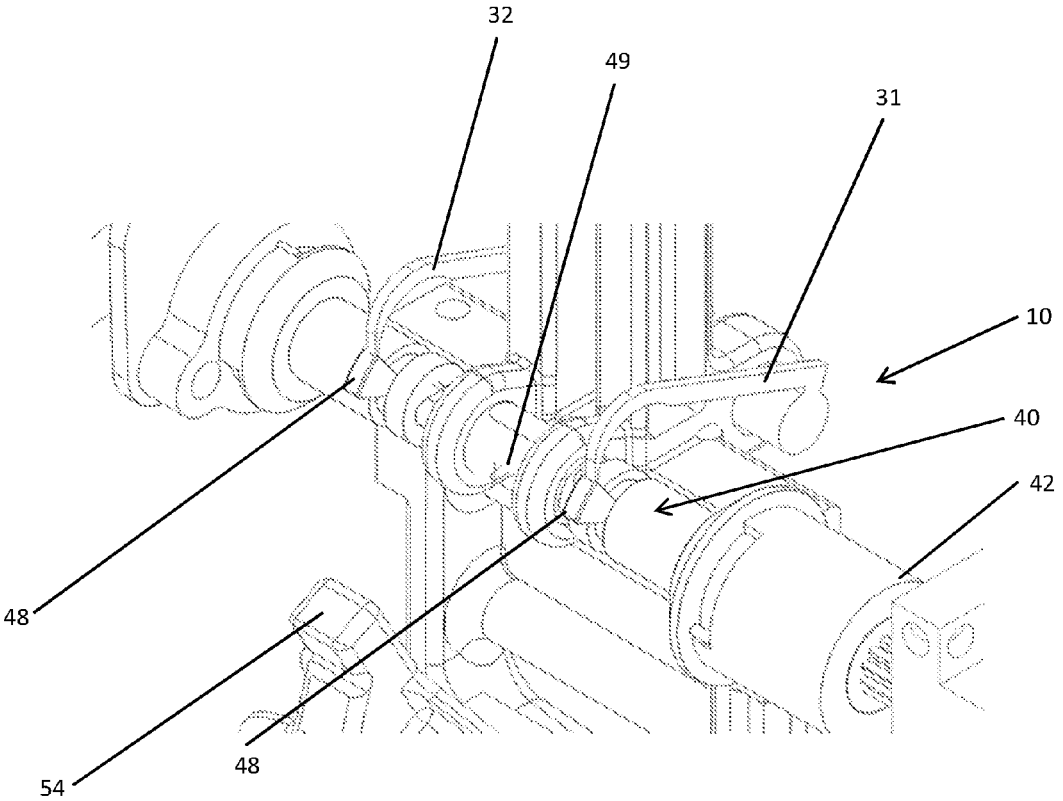
FIG. 5B is a partial frontal perspective views of the cargo hook assembly of FIG. 2 in a fully secured state depicting the remote electrical module in greater detail.

The remote electrical module 42 is depicted in greater detail in FIGS. 5A and 5B. FIG. 5A depicts the link-less cargo hook assembly 10 in a fully secured state. FIG. 5B depicts the shaft assembly 40 after being rotated by the remote electrical module 42. Prongs 48 lift pivotal clamp arms 31, 32 away from the shaft assembly 40. The rotation also allows tongue 54 to pass through notch or clamp groove 49 in shaft assembly 40 and allows clamp 50 to pivot into an open position. In one embodiment, the remote mechanical module 44 and local mechanical release 46 (depicted in FIGS. 6A and 6B) are not moved by this operation of the remote electrical module 42.

Figure 6A:
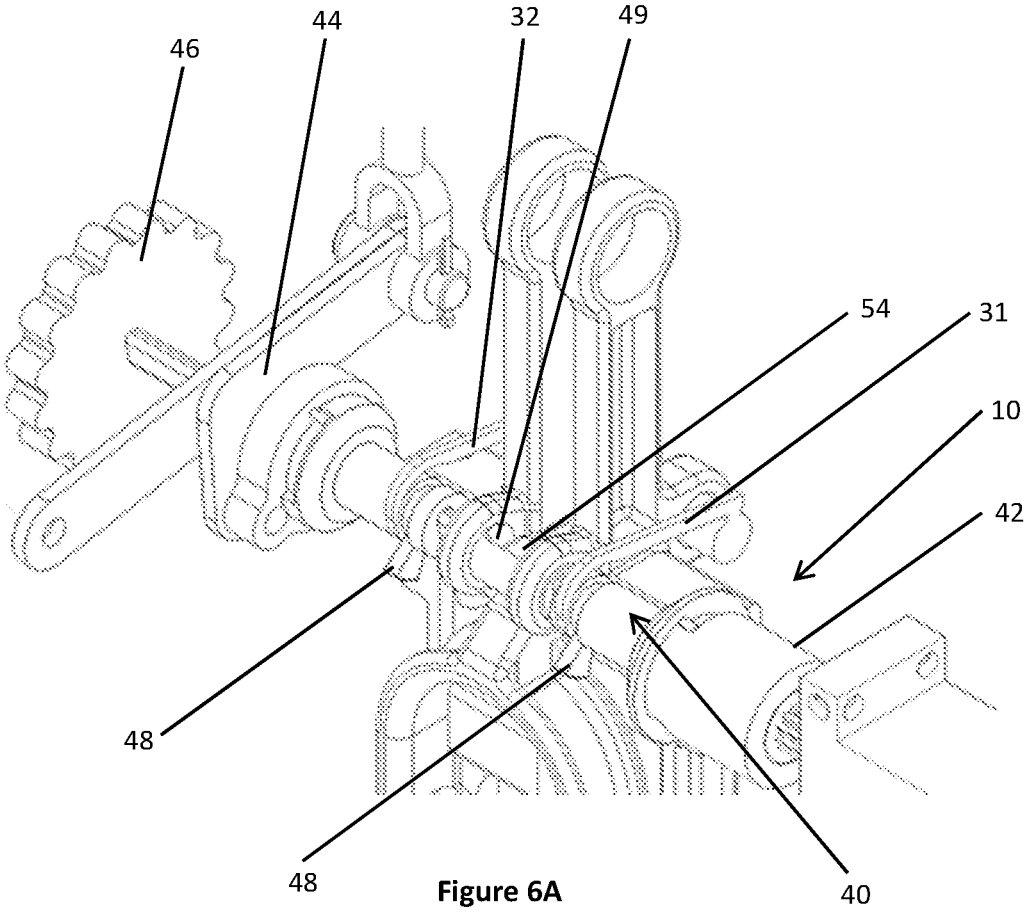
FIG. 6A is a partial frontal perspective views of the cargo hook assembly of FIG. 2 in a fully open state depicting the remote mechanical module and local mechanical release in greater detail.
Figure 6B:
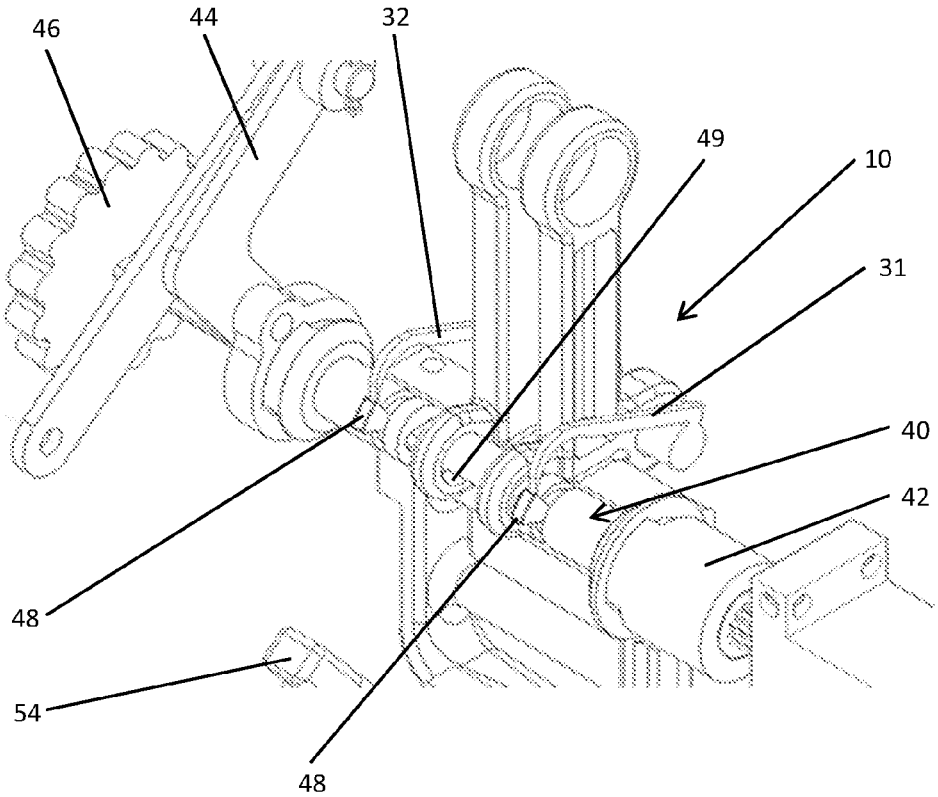
FIG. 6B is a partial frontal perspective view of the cargo hook assembly of FIG. 2 in a fully secured state depicting the remote mechanical module and local mechanical release in greater detail.

The remote mechanical module 44 and local mechanical release 46 are depicted in greater detail in FIGS. 6A and 6B. FIG. 6A depicts the link-less cargo hook assembly 10 in a fully secured state. FIG. 6B depicts the shaft assembly 40 after being rotated by the remote mechanical module 44 or local mechanical release 46. Prongs 48 lift pivotal clamp arms 31, 32 away from the link-less cargo hook assembly 10. The rotation also allows tongue 54 to pass through notch 49 and allows clamp 50 to pivot into an open position. In one embodiment, the remote mechanical module 44 and local mechanical release 46 are moved independently of one another by this operation and do not move remote electrical module 42. In one embodiment the local mechanical release 46 is directly attached to the shaft assembly 40 and they rotate together. In another embodiment, the local mechanical release 46 only engages the shaft assembly 40 when pushed reducing the risk of inadvertent operation. In another embodiment the connector strap 12 is attached at the other end to the frame 20. This allows the use of conventional cargo hook attachment equipment such as clevises.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed:

1. A cargo hook assembly for use in a casing, the cargo hook assembly comprising:

a connector strap having a transverse flange and a tip;

a lower kicker having a ledge complementary to the transverse flange, a clip extending from the ledge, and defining a gap that accommodates the tip;

a frame extending from a first end to a second end;

a clamp having a tongue and pivoting about a lower post of the frame adjacent the first end defining a latch bar clamp away from the lower post;

an upper kicker pivoting about the frame adjacent the second end; and a shaft assembly adjacent the second end, the shaft assembly comprising a rotating means having a rotatable shaft, a clamp groove complementary to the tongue, and a kicker groove complementary to the upper kicker, the rotating means operatively connected to the shaft assembly;

wherein the transverse flange engages the ledge and propels the lower kicker towards the second end of the frame and the clip rotates the clamp towards the second end, the upper kicker engages the shaft assembly at the kicker groove, the tongue engages the shaft assembly at the clamp groove, and the rotating means rotate the rotatable shaft to engage or disengage the shaft assembly from the upper kicker and tongue.

2. The cargo hook assembly of claim 1, wherein the rotating means is a remote electrical module.

3. The cargo hook assembly of claim 2 and further comprising a plurality of clamp arms, wherein prongs on the shaft assembly lift the clamp arms away from the cargo hook assembly.

4. The cargo hook assembly of claim 1, wherein the rotating means is a remote mechanical module.

5. The cargo hook assembly of claim 1, wherein the rotating means is a local mechanical module.

6. The cargo hook assembly of claim 1, wherein said upper kicker comprises a plurality of J-shaped clamp arms.

7. The cargo hook assembly of claim 1, wherein the lower kicker is retained in a sleeve of the casing when the cargo hook assembly is not in use.

8. The cargo hook assembly of claim 1, wherein the clip contacts the latch bar of the clamp to rotate the clamp.

9. The cargo hook assembly of claim 1, wherein the clamp engages the upper kicker and rotates the rotating means.

10. The cargo hook assembly of claim 1, further comprising a plurality of independently operable rotating means.

11. A cargo hook assembly for use in a casing, the cargo hook assembly comprising:

a connector strap having a transverse flange and a tip;

a lower kicker having a ledge complementary to the transverse flange, a clip extending from the ledge, and defining a gap that accommodates the tip;

a frame extending from a first end to a second end;

a clamp having a tongue and pivoting about a lower post of the frame adjacent the first end defining a latch bar clamp away from the lower post;

an upper kicker pivoting about the frame adjacent the second end; and a shaft assembly adjacent the second end, the shaft assembly comprising a rotatable shaft, a remote electrical module, a remote mechanical module, and a local mechanical release, the rotatable shaft comprising a clamp groove complementary to the tongue and a kicker groove complementary to the upper kicker, the remote electrical module, remote mechanical module, and local mechanical release being operatively connected to the shaft assembly;

wherein the transverse flange engages the ledge and propels the lower kicker towards the second end of the frame and the clip rotates the clamp towards the second end, the upper kicker engages the shaft assembly at the kicker groove, the tongue engages the shaft assembly at the clamp groove, and the remote electrical module, the remote mechanical module, or the local mechanical release rotate the rotatable shaft to engage or disengage the shaft assembly from the upper kicker and tongue.

12. The cargo hook assembly of claim 11, wherein said upper kicker comprises a plurality of J-shaped clamp arms.

13. The cargo hook assembly of claim 12, wherein prongs on the shaft assembly lift the J-shaped clamp arms away from the cargo hook assembly.

14. The cargo hook assembly of claim 11, wherein the lower kicker is retained in a sleeve of the casing when the cargo hook assembly is not in use.

15. The cargo hook assembly of claim 11, wherein the clip contacts the latch bar of the clamp to rotate the clamp.

16. The cargo hook assembly of claim 11, wherein the clamp engages the upper kicker and rotates the rotatable shaft independently of the remote electrical module, the remote mechanical module, or the local mechanical release.

17. The cargo hook assembly of claim 11, wherein the remote mechanical module, the local mechanical release, and the remote electrical module move independently of one another.

18. The cargo hook assembly of claim 11, wherein the local mechanical release is directly attached to the shaft assembly and they rotate together.

19. The cargo hook assembly of claim 11, wherein the local mechanical release only engages the rotatable shaft when pushed.

20. The cargo hook assembly of claim 11, wherein the connector strap is attached to the frame.

* * * * *